US008561212B2

(12) United States Patent
Saotome

(10) Patent No.: US 8,561,212 B2
(45) Date of Patent: Oct. 22, 2013

(54) UNDERWATER DRYSUIT

(75) Inventor: Katsuhiko Saotome, Tokyo (JP)

(73) Assignee: Zero Corporation, Tokyo (JP)

( * ) Notice: Subject to any disclaimer, the term of this patent is extended or adjusted under 35 U.S.C. 154(b) by 195 days.

(21) Appl. No.: 13/146,754

(22) PCT Filed: Nov. 29, 2010

(86) PCT No.: PCT/JP2010/071218
§ 371 (c)(1),
(2), (4) Date: Jul. 28, 2011

(87) PCT Pub. No.: WO2011/083638
PCT Pub. Date: Jul. 14, 2011

(65) Prior Publication Data

US 2011/0277203 A1 Nov. 17, 2011

(30) Foreign Application Priority Data

Jan. 8, 2010 (JP) ..... 2010-002695

(51) Int. Cl.
*B63C 11/04* (2006.01)

(52) U.S. Cl.
USPC ..... 2/2.17; 2/2.15

(58) Field of Classification Search
USPC ..... 2/2.15, 2.17, 96, 128, 218, 234, 265, 2/270, 456
See application file for complete search history.

(56) References Cited

U.S. PATENT DOCUMENTS

| | | | | | |
|---|---|---|---|---|---|
| 1,706,097 | A | * | 3/1929 | Aud | 441/103 |
| 3,731,319 | A | * | 5/1973 | O'Neill | 2/2.17 |
| 3,872,551 | A | * | 3/1975 | Moertel | 24/388 |
| 5,386,616 | A | * | 2/1995 | Norvell | 24/389 |

(Continued)

FOREIGN PATENT DOCUMENTS

| | | | |
|---|---|---|---|
| EP | 2044855 | A1 | 4/2009 |
| JP | 41-15725 | A | 7/1966 |

(Continued)

OTHER PUBLICATIONS

JP Office Action issued Feb. 9, 2010 in corresponding JP Appln No. 2010-002695.

*Primary Examiner* — Khoa Huynh
*Assistant Examiner* — Andrew W Collins
(74) *Attorney, Agent, or Firm* — Novak Druce Connolly Bove + Quigg LLP

(57) ABSTRACT

This underwater drysuit has a waterproof zipper device 30 that opens/closes and defines a body covering/uncovering opening part 22 that is provided extending from one of shoulder parts to the other one of the shoulder parts on top of arms across a chest part of a drysuit main body 20 in a chest width direction. This device is configured in the form of a horizontal line in the chest width direction to have a dual structure with a first waterproof zipper 40 and a second zipper 50 located above the first waterproof zipper in a vertical direction. The underwater drysuit has a reinforcing material that includes an open angle suppressing part, which is joined to a rear fabric along with both two tapes of the first waterproof zipper along outer circumferences of the both tapes, from a rear side of the first waterproof zipper, and suppresses an open angle between the both tapes to be opened by a slider of the first waterproof zipper, when the slider is moved and stopped at a lower end position, which is a largest opening position of the first waterproof zipper.

16 Claims, 6 Drawing Sheets

(56) References Cited

U.S. PATENT DOCUMENTS

| | | | | |
|---|---|---|---|---|
| 5,802,609 | A * | 9/1998 | Garofalo | 2/2.17 |
| 5,940,879 | A * | 8/1999 | Whitehouse | 2/2.17 |
| 6,092,266 | A * | 7/2000 | Lee | 24/389 |
| 6,223,349 | B1 * | 5/2001 | Roiser | 2/2.17 |
| 6,357,048 | B2 * | 3/2002 | Griffiths | 2/2.17 |
| 6,998,082 | B2 * | 2/2006 | Yang | 264/156 |
| 7,624,482 | B2 * | 12/2009 | Kusayama et al. | 24/432 |
| 2001/0047530 | A1 * | 12/2001 | Griffiths | 2/2.17 |
| 2005/0040559 | A1 * | 2/2005 | Yang | 264/275 |
| 2006/0150292 | A1 * | 7/2006 | Roy | 2/2.15 |
| 2006/0207070 | A1 * | 9/2006 | Lee | 24/389 |
| 2007/0017008 | A1 * | 1/2007 | Snedeker et al. | 2/456 |
| 2007/0186326 | A1 | 8/2007 | Myerscough | |
| 2007/0251063 | A1 | 11/2007 | Kusayama et al. | |
| 2007/0277277 | A1 * | 12/2007 | Moore | 2/2.15 |
| 2007/0277278 | A1 * | 12/2007 | O'Brien | 2/2.17 |
| 2008/0040837 | A1 * | 2/2008 | King et al. | 2/227 |
| 2009/0100557 | A1 * | 4/2009 | Insulan | 2/2.17 |
| 2009/0265829 | A1 * | 10/2009 | Gomes Seguin et al. | 2/87 |
| 2010/0005557 | A1 * | 1/2010 | Cossutti et al. | 2/2.17 |
| 2010/0115684 | A1 * | 5/2010 | Freedman et al. | 2/128 |

FOREIGN PATENT DOCUMENTS

| | | | |
|---|---|---|---|
| JP | 6-23897 | | 3/1994 |
| JP | 11-310193 | A | 11/1999 |
| JP | 2000-510413 | A | 8/2000 |
| JP | 2007-296190 | A | 11/2007 |
| JP | 2008-223206 | A | 9/2008 |
| JP | 2009-90108 | A | 4/2009 |
| JP | 2009-526916 | A | 7/2009 |
| WO | WO-9846480 | A1 | 10/1998 |

* cited by examiner

UNDERWATER DRYSUIT

CROSS REFERENCE TO RELATED APPLICATIONS

This application is a National Phase filing under 35 U.S.C. §371 of PCT/JP2010/071218 filed on Nov. 29, 2010; and this application claims priority to Application No. 2010-002695 filed in Japan on Jan. 8, 2010 under 35 U.S.C. §119; the entire contents of all are hereby incorporated by reference.

TECHNICAL FIELD

The present invention relates to an underwater drysuit that can be worn and taken off easily by a user by himself/herself.

BACKGROUND ART

A diving suit is one type of an underwater suit. Wetsuits and drysuits have been conventionally known as this type of diving suit. The major difference between a wetsuit and a drysuit is that the drysuit has a flexible waterproof zipper (also referred to as "water guard") in, for example, a body covering/uncovering opening part of the suit.

A diving drysuit takes safety measures by preventing any damage or problems of the waterproof zipper, air supply valve and air exhaust valve.

Normally, the waterproof zipper has elements along inner rims (facing each other) of two strips of elastic, waterproof tape. The waterproof zipper is structured to open/close the watertight (also referred to as "airtight") engagement between the elements by means of the strips of tape. The right and left strips of tape are opened widely in an oblique direction and strongly pulled, when both of the strips of tape are moved to forcibly open/close the waterproof zipper. Forcibly opening/closing the waterproof zipper often causes problems in the waterproof zipper such as weakening the engagement between the elements and consequently reducing the airtightness therebetween or damaging the zipper itself as a slider comes off of the elements.

Therefore, when a person wears, by himself/herself, a conventional normal diving suit that has a waterproof zipper for opening/closing the body covering/uncovering opening part on the back of the diving drysuit, he/she needs to carefully wear or take off the suit so that the waterproof zipper does not break. This makes it significantly difficult to open/close the waterproof zipper.

There are proposed a variety of technologies on the placement of the waterproof zipper in order to form a covering/uncovering opening part of a diving suit (see Patent Documents 1, 2 and 3, for example).

Patent Document 1 discloses a diving suit that is provided with a covering/uncovering waterproof zipper passing through the back face of the main body of the diving suit from one of the shoulder surfaces to the other.

Patent Document 2 discloses a diving suit that is provided with a zipper which extends diagonally from a shoulder to the waist across the forward portion of the covering/uncovering upper torso portion.

Patent Document 3 discloses a diving suit in which a covering/uncovering waterproof zipper is disposed horizontally a back upper part so as to reach an upper part of either arm part.

Patent Document 1: Japanese Patent Application Publication No. H11-310193

Patent Document 2: Japanese Translation of PCT Application No. 2000-510413

Patent Document 3: Unexamined Utility Model Application Publication No. H6-23897

In the diving suits disclosed in Patent Documents 1 and 3, substantially part or the whole of the covering/uncovering waterproof zipper is placed on the back, which makes it difficult for a wearer to operate the zipper when wearing the diving suits by himself/herself. Thus, the wearer needs to have somebody open/close the waterproof zipper in order to wear or take off the diving suits smoothly.

The diving suit disclosed in Patent Document 1 claims that one can wear or take off the diving suit by himself/herself, but it is still difficult to smoothly open/close the waterproof zipper on the back of the neck of the diving suit.

In the case of the diving suit disclosed in Patent Document 2, the wearer can wear or take off the diving suit by himself/herself, due to the location of the covering/uncovering waterproof zipper. However, if the diving suit is a drysuit when the wearer stands up nearly straight in this diving suit, the pressure of the air remaining in the diving suit (the pressure here is referred to as "internal pressure" hereinafter) is normally approximately −0.8 atmospheres in each leg part, and the internal pressure in the chest part, especially the upper chest part, is as high as approximately 1.2 to 1.3 atmospheres. As a result, the waterproof zipper 10 partially swells up at the upper chest part due to the local high internal pressure, as shown in FIG. 1(A) (indicated by a reference numeral 10*a* in the diagram), causing a deformation or unevenness. When the wearer dives into the water or bends over under the water in this diving suit with such swelling of the waterproof zipper, the internal pressure concentrates on the swollen part and increases drastically, and, as a result, causes air-tightness between the elements, by worsening the engagement cracks in the waterproof zipper, generates a pinhole, and causes rupturing breakage (also referred to as "breakage") of the zipper itself (indicated by a reference numeral 10*b* in the diagram).

In the case of a conventional waterproof zipper, if an external force forcibly acts on the waterproof zipper to open up both tapes of the waterproof zipper at the maximum open angle or more when wearing or taking off the diving drysuit, a slight difference in degree of stretching is generated between the tapes, thereby deteriorating the engagement between the elements, removing the elements from the slider of the waterproof zipper, and causing other damage to the waterproof zipper. For this reason, the wearer cannot wear the drysuit.

As described above, the problem in the conventionally known diving drysuit is that it does not have adequate countermeasures to not only the safety of the waterproof zipper but also the occurrence of problems and damage in the waterproof zipper.

For the purpose of solving the problems described above, the inventor of the present application came up with the following points as a result of keen investigations.

(1) A waterproof zipper, used for wearing or taking off a drysuit, is disposed in a chest part, or particularly in an upper chest part, in a chest width direction, so that a wearer can easily open/close the waterproof zipper on the chest without having a help of somebody.

(2) Another zipper is provided on a front fabric (also referred to as "outer zipper") to cover the upper side of the waterproof zipper (also referred to as "inner waterproof zipper"). The placement relationship between the waterproof zipper and the outer zipper is set in order to prevent swelling of the inner waterproof zipper as much as possible by pressing from the top, that is, from the outside, the inner waterproof zipper located under the outer zipper, by means of a combination of the front fabric, tensioned as a result of closing the outer zipper, and the outer zipper. This can prevent breakage of the waterproof zipper caused by local swelling thereof.

(3) In addition, when a slider of the inner waterproof zipper is moved and stopped at a position of a lower end (also referred to as "slider end part") (referred to as "lower end position" hereinafter), which is a largest opening position, both tapes of the inner waterproof zipper are prevented from opening up at the maximum open angle or more, so that a strong pull force does not act on the tapes. In order to do so, an area facing the lower end and the slider at the lower end position may be provided with means for preventing the tapes from opening up at an excessively large open angle from the slider that is stopped at the lower end position.

DISCLOSURE OF THE INVENTION

A first object of the present invention is to provide an underwater drysuit that can be worn and taken off easily by a wearer by himself/herself.

A second object of the present invention is to provide an underwater drysuit that prevents damage or problems caused by internal pressure of a waterproof zipper for opening/closing an opening part used for wearing and taking off the underwater drysuit.

A third object of the present invention is to provide an underwater drysuit that is configured to prevent breakage or problems in a waterproof zipper for opening an opening part used for wearing and taking off the drysuit even when the opening part is opened to the maximum.

Therefore, the aspects of the present invention is as follows.

According to a first aspects of the present invention, an underwater drysuit has a body covering/uncovering opening part that extends one of shoulder parts to the other one of the shoulder parts on top of arms in a chest width direction across a chest part, particularly an upper chest part of the drysuit.

The opening part has a waterproof zipper device that opens/closes and defines the opening part.

According to a second aspects of the present invention, the waterproof zipper device described above is configured to have a dual structure with a first waterproof-type zipper (also referred to as "first waterproof zipper" hereinafter) and a second zipper located above the first waterproof zipper in a vertical direction, that is, located on the outside of a drysuit main body in an inward/outward direction, and is provided in the shape of a horizontal line in the chest width direction described above.

The first waterproof zipper is joined to a rear fabric of the drysuit main body and defines a main opening of the above-mentioned opening part.

The second zipper is longer than the first waterproof zipper, is joined to a front fabric of the drysuit, and defines a first sub-opening larger than the main opening, above the main opening.

The second zipper is provided in an arrangement relationship in which the second zipper overlaps entirely or partially with the first waterproof zipper so as to press the first waterproof zipper closed from thereabove combined with the front fabric of the drysuit when the drysuit is worn by a user and the second zipper is closed.

According to third aspects of the present invention, the underwater drysuit has a reinforcing material that is joined to the rear fabric with tapes of the first waterproof zipper, from the rear of the first waterproof zipper along an outer circumference of each of the tapes. This reinforcing material includes an open angle suppressing part that suppresses an open angle of the tapes opened by a slider of the first waterproof zipper when the slider is moved and stopped at a position in a first lower end (this position is referred to as "first lower end position"), which is a largest opening position of the first waterproof zipper.

According to a preferred embodiment of the present invention, the open angle suppressing part may be formed from a flat member that has a base part and a branching part branching into two pieces from the base part.

According to another preferred embodiment of the present invention, the flat part may be a fabric.

According to yet another preferred embodiment of the present invention, the open angle suppressing part may be provided in an area facing the first lower end and the slider stopped at the first lower end position.

According to yet another preferred embodiment of the present invention, the open angle suppressing part may be formed from a material harder than that of the first waterproof zipper.

According to yet another preferred embodiment of the present invention, a central section of the second zipper corresponding to a central area of the chest part described above may be positioned downward in a height direction of the drysuit so as to be lower than a shoulder side section corresponding to a shoulder side area.

According to yet another embodiment of the present invention, the second zipper may intersect with the first waterproof zipper between the shoulder side section and the central section in an area of the chest part.

Alternatively, the second zipper may be provided as first and second sub-zippers that are separated on left and right hand side of the central section described above.

It is preferred that the underwater drysuit described above be applied especially as a diving drysuit.

In addition, it is preferred that the underwater drysuit described above be applied as a drysuit used in any of the aquatic sports such as surfing, body surfing, sailing, and jet-skiing, or as a drysuit used in underwater work.

According to the underwater drysuit of the first aspects described earlier, the waterproof zipper device of the covering/uncovering opening part is provided with the waterproof-type first zipper, that is, the first waterproof zipper, that opens/closes and defines the main opening-, extending between the areas of the shoulder parts in the chest width direction across the chest. Therefore, the first waterproof zipper can be opened/closed within a range where the wearer can visually check and make his/her hands reach each other on the chest part side. As a result, compared to the conventional drysuits, the waterproof zipper can be opened/closed more easily, accomplishing the effects of further preventing the problems or breakage of the first waterproof zipper.

Furthermore, the waterproof zipper device provided in the chest area produces various advantages that the fabric on the back is not tensioned, that moving performances of the upper body and both arms are significantly higher than those of the conventional drysuits, and that an air supply valve and an air exhaust valve can be attached to sections where the operability thereof is enhanced.

In addition to the effects described above, the underwater drysuit of the second aspects is provided with the second zipper longer than the first waterproof zipper so as to be able to press from the upper side the first waterproof zipper, closed and located on the inside when the wearer wears the drysuits, combined with the front fabric, tensioned as a result of closing the second zipper on the outside, and the second zipper. For this reason, further expansion of the swelling of the first waterproof zipper caused by the internal pressure can be prevented, accomplishing the effects of preventing the engagement between the elements from worsening due to local swelling of the first waterproof zipper, preventing the air-tightness between the elements from worsening due to disengagement therebetween, preventing the occurrence of problems such as rupture and breakage of the waterproof zipper, and improving the safety of wearing the underwater drysuit more than the conventional drysuits.

In addition to the two effects described above, according to the diving drysuit of the third aspects, the open angle suppressing part of the reinforcing material provided under the first waterproof zipper restricts the open angle of the tapes of the first waterproof zipper, even when a external force such as a strong pull force acts on the tapes to open the tapes at the maximum open angle or more. This can accomplish the effects of preventing the abovementioned damage or problems of the first waterproof zipper and improving the safety of the diving drysuit more than the conventional drysuits.

Because the open angle suppressing part is configured to have the branching part branching into two pieces, the open angle suppressing part can be joined to the rear fabric so as to correspond to the tapes at a position that can securely suppress the open angle of the tapes.

The flat member made of fabric has a advantage that the flat member is soft, flexible and bendable, allowing it to be formed of a harder material than that of the tapes of the first waterproof zipper.

The open angle suppressing part is provided in the area facing the lower end and the slider stopped at the lower end position, so that the open angle of the tapes can be securely suppressed.

Forming the open angle suppressing part from a material harder than the material of the tapes of the first waterproof zipper can restrict the open angle of the branching part of the open angle suppressing part joined to the tapes, and securely suppress the open angle of the tapes to a small open angle corresponding to the open angle of the branching part, even when a strong external force acts on the tapes.

By positioning the central section of the second zipper below the shoulder side section, or by allowing the first waterproof zipper and the second zipper to intersect with each other between the shoulder side section and the central section, a V-shaped part that is high on the shoulder part side and low on the central part side can be provided. Therefore, the placement of the zippers can accord with the movement of a hand of the wearer, facilitating the operation of the zipper.

Moreover, because the second zipper is provided as the first and second sub-zippers on the left and right hand side, the sub-zipper on the right hand side can be opened/closed by the right hand of the wearer, and the sub-zipper on the left hand side can be opened/closed by the left hand of the wearer. Accordingly, the operability of the opening/closing operation of the zippers can be further improved.

BEST MODE FOR CARRYING OUT THE INVENTION

Figure 1A:
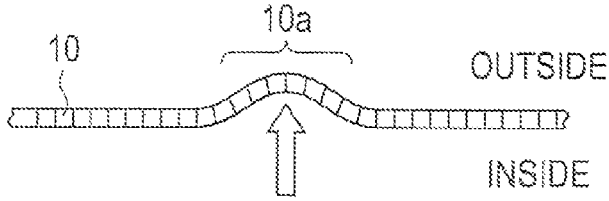
FIGS. 1(A) and 1(B) are explanatory diagrams illustrating the problems of a waterproof zipper used in a conventional drysuit.
Figure 1B:
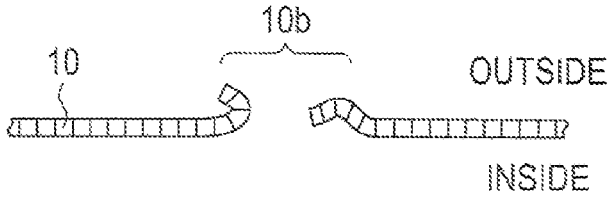

Preferred embodiments of the present invention are described with reference to the drawings. Specific embodiments might become clear from the following descriptions. Note that the embodiments described hereinafter are merely preferred embodiments, and therefore that the present invention should not be restricted to the following embodiments. It should be understood that the present invention is implemented without having one, two or more characteristics of each of the embodiments. In addition, each of the drawings are simply illustrated schematically to a degree sufficient for a person to understand the configuration of each of the preferred embodiments of the present invention. Therefore, those skilled in the art can easily understand that the present invention is not limited to the configurations illustrated in the drawings.

Figure 2:
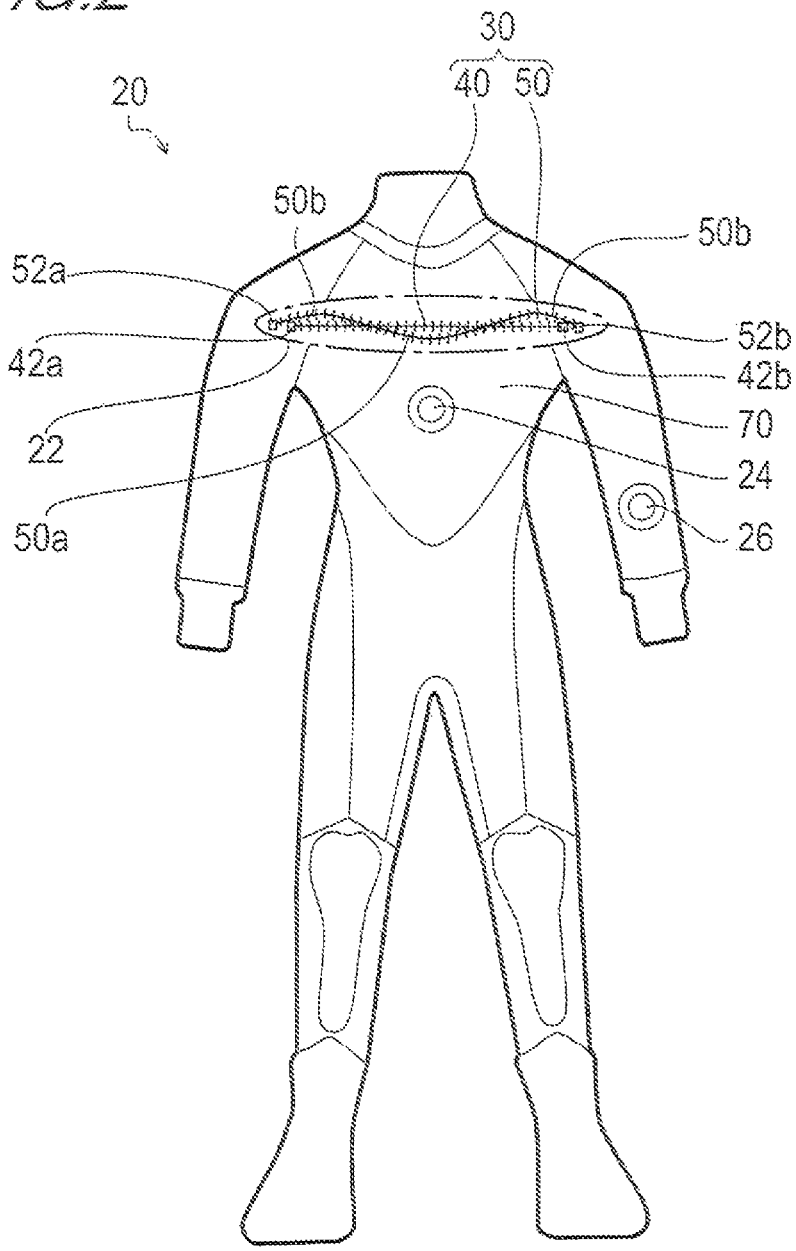
FIG. 2 is an explanatory diagram for illustrating a placement relationship between a first waterproof zipper and second zipper on a drysuit main body that configure a waterproof zipper device applied in a preferred embodiment of the underwater drysuit of the present invention.
Figure 3:
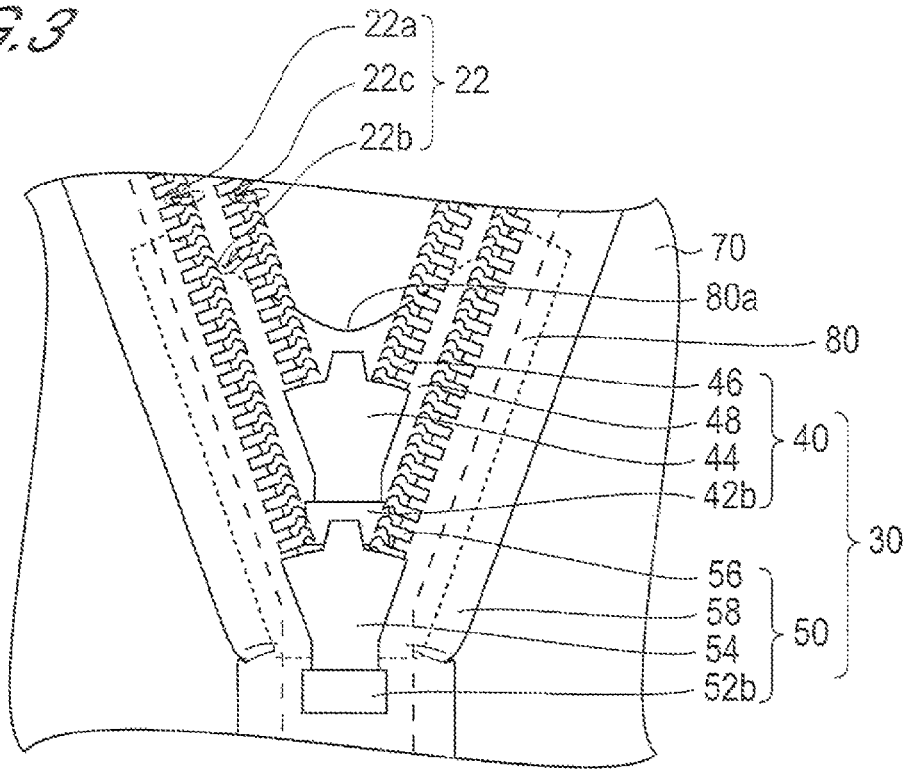
FIG. 3 is a schematic plan view of substantial parts for illustrating a placement relationship among a waterproof-type first zipper, or a first waterproof zipper, a second zipper, and an open angle suppressing part, which configure the waterproof device applied in the preferred embodiment of the underwater drysuit of the present invention.
Figure 4:
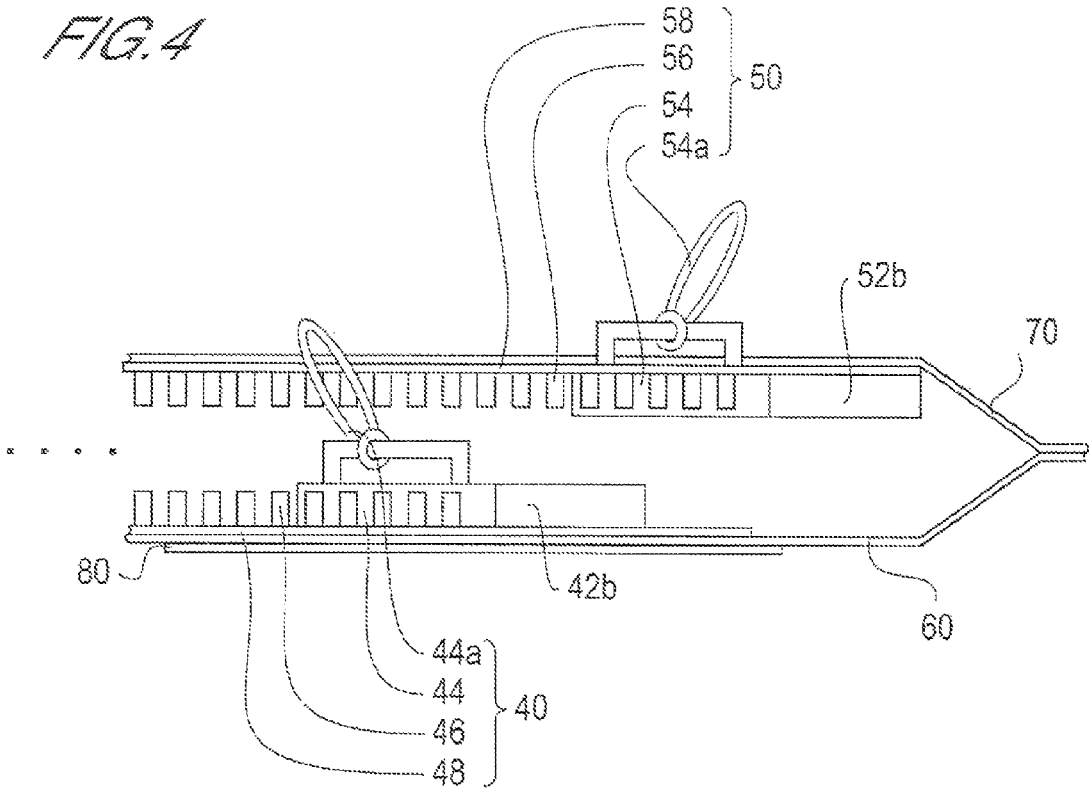
FIG. 4 is a schematic view of substantial parts for illustrating a placement relationship among the first waterproof zipper, the second zipper and the open angle suppressing part in a vertical direction, which configure the waterproof zipper device applied in the preferred embodiment of the underwater drysuit of the present invention.
Figure 5A:
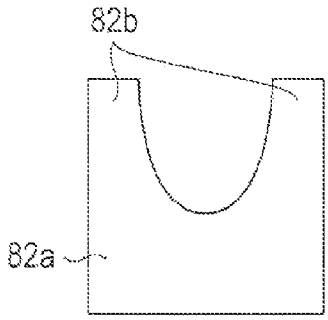
FIGS. 5(A) to 5(F) are schematic views, each illustrating a modification of the open angle suppressing part shown in FIG. 4.
Figure 5B:
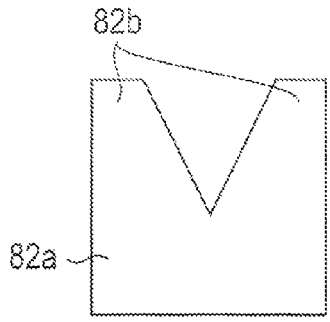
Figure 5C:
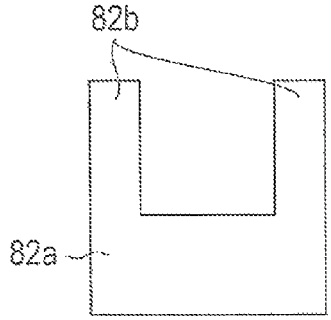
Figure 5D:
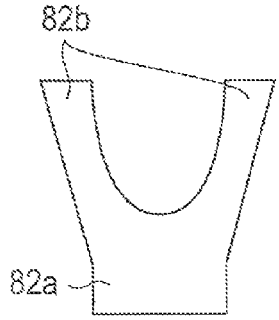
Figure 5E:
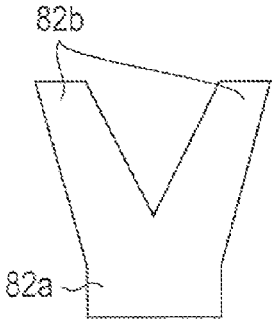
Figure 5F:
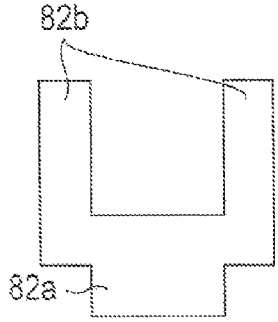

First of all, as a preferred embodiment of the underwater drysuit of the present invention, a diving drysuit is described using FIGS. 2, 3 and 4.

FIG. 2 schematically shows a diving drysuit main body 20 viewed from the front.

FIG. 3 schematically shows part of a waterproof zipper device of the diving drysuit, with a slider of each zipper moved toward a lower end side to open the zippers at a largest opening position.

FIG. 4 schematically shows a placement state in which a first waterproof zipper and second zipper are attached between a rear fabric and front fabric of the drysuit main body.

The drysuit main body 20 of the diving drysuit has a body covering/uncovering opening part 22 (shown schematically by a one-dot chain line in FIG. 2) for a wearer that extends between shoulder parts of arms across an area of a chest part in a chest width direction.

In FIG. 2, reference numeral 24 represents an air supply valve and 26 an air exhaust valve. The detailed descriptions thereof are omitted as they are not the characteristic components required in the configurations of the present invention.

The opening part 22 has a waterproof zipper device 30 that opens/closes and defines the opening part 22. As will be described hereinafter with reference to FIG. 3, this opening part 22 is configured by, for example, a first sub-opening 22*a*, second sub-opening 22*b*, and main opening 22*c*.

The waterproof zipper device 30 is preferably configured to have mainly a dual structure with a first waterproof zipper 40, which is a waterproof-type first zipper, and a second zipper 50 located above the first waterproof zipper 40 in a vertical direction, which is an inward/outward direction (also referred to as "rear/front direction") of the drysuit main body. In this configuration example, therefore, the first waterproof zipper 40 is located on the wearer's body side, which is also referred to as "inside of the drysuit 20" or "lower zipper." On the other hand, the second zipper is also referred to as "outer zipper" or "upper zipper," since the second zipper 50 is located on the side where it contacts water.

The waterproof zipper device 30 is preferably provided so as to extend in the shape of a horizontal line between right and left arms in an upper chest part.

The first waterproof zipper 40, joined to the rear fabric of the drysuit main body 20 (indicated by a reference numeral 60 in FIG. 4), is opened/closed by first elements 46 that are brought into engagement with each other by the movement of a first slider 44 (see FIG. 3) between a first upper end 42*a* and a first lower end 42*b*, by, for example, a first pulling cord 44*a*. The first waterproof zipper 40 defines the main opening (similarly indicated by a reference numeral 22*c* in FIG. 3) of the opening part 22. As already known, these first elements 46 are arranged in two lines facing each other, and the main opening 22*c* is formed between the lines of the both elements.

The first waterproof zipper 40 is normally joined to the rear fabric, as described above, by air-tightly or water-tightly joining outer rims of two tapes (similarly illustrated as "first tapes 48" in FIG. 3) of the first waterproof zipper 40 to the rear fabric 60 (see FIG. 4). If need be, thus obtained stitches are coated by a waterproof treatment.

As described above, the first waterproof zipper 40 can be provided in the chest, especially in the upper chest part, in the shape of, preferably, a horizontal line, or a straight line. Therefore, opening/closing of the first waterproof zipper 40 can be performed carefully while checking it visually. As a result, the occurrence of conventional problems in the waterproof zipper can be prevented adequately.

In this embodiment, a non-waterproof zipper is used as the second zipper 50, but a waterproof zipper may be used. The second zipper 50 is preferably longer than the first waterproof zipper 40.

The second zipper 50 is joined to a front fabric 70 of the drysuit main body 20 (indicated by a reference numeral 70 in FIGS. 3 and 4), and defines the first sub-opening 22*a*, larger than the main opening 22*c*, above the main opening 22*c*. More specifically, the second zipper 50 opens/closes second elements 56 that are brought into engagement with each other by the movement of a second slider 54 (see FIGS. 2 and 3) between a second upper end 52*a* and a second lower end 52*b* on both ends of the second zipper 50, by, for example, a second pulling cord 54*a*. The second zipper 50 also defines the first sub-opening of the opening part 22 (indicated by a reference numeral 22*a* in FIG. 3). As already known, these second elements 56 are arranged in two lines facing each other, and the first sub-opening 22*a* is formed between the lines of the both elements.

Since the second zipper 50 is not waterproof, outer rims of two tapes of the second zipper 50 may be joined to the front fabric 70 (similarly illustrated as "second tapes 58" in FIG. 3) by a normal sewing method. When the second zipper 50 is made waterproof, naturally, the second zipper 50 is air-tightly or water-tightly joined to the fabric in the same manner as the first waterproof zipper, or the stitches thereof need to be coated by a waterproof treatment, if need be.

Furthermore, when the second zipper 50 is closed after the wearer puts on the drysuit main body 20, it is preferred, in terms of the opening/closing operation of the zipper, that the second zipper 50 be provided in a placement relationship in which the second zipper 50 partially overlaps with the first waterproof zipper 40 so as to press, from above, the closed first waterproof zipper 40 combined with the front fabric 70 of the drysuit main body 20. In this case, the second zipper 50 may be stitched and fixed to the front fabric 70 such that the facing lines of the second elements 56 of the second zipper 50 come into engagement with each other and thereby pulls and tensions the front fabric 70.

As shown in FIG. 2, for example, the second zipper 50 is configured such that a central section 50*a* corresponding to a central area of the chest part is positioned downward in a height direction of the drysuit so as to be lower than each shoulder side section 50*b* corresponding to a shoulder side area. By providing the second zipper 50 in this configuration, the left half and the right half of the second zipper 50 can be opened/closed easily by using either right or left hand, whichever is more comfortable for the wearer.

Especially by allowing the second zipper 50 to intersect with the first waterproof zipper 40 between each shoulder side section 50*b* and the central section 50*a* in the area of the chest part, the placement of the zippers can accord with the movement of the right or left hand of the wearer, facilitating the opening/closing operation of the zipper.

Because the second zipper 50 is a zipper that is not provided in the conventional drysuits, the second zipper 50 needs to facilitate a smooth opening/closing operation thereof in order to break down the troublesome occurring when wearing or taking off the drysuit. The second zipper 50 can be smoothly operated by forming the second zipper 50 into a curve that accords with the movement of the wearer's hand as described above.

Figure 6:
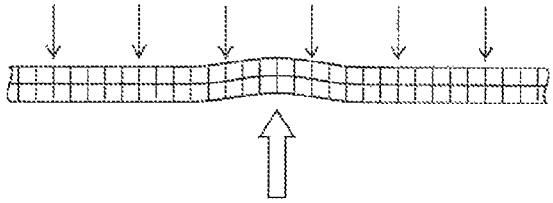
FIG. 6 is a schematic plan view of substantial parts for illustrating actions of the second zipper on the first waterproof zipper configuring the waterproof zipper device applied in the preferred embodiment of the invention.
Figure 7:
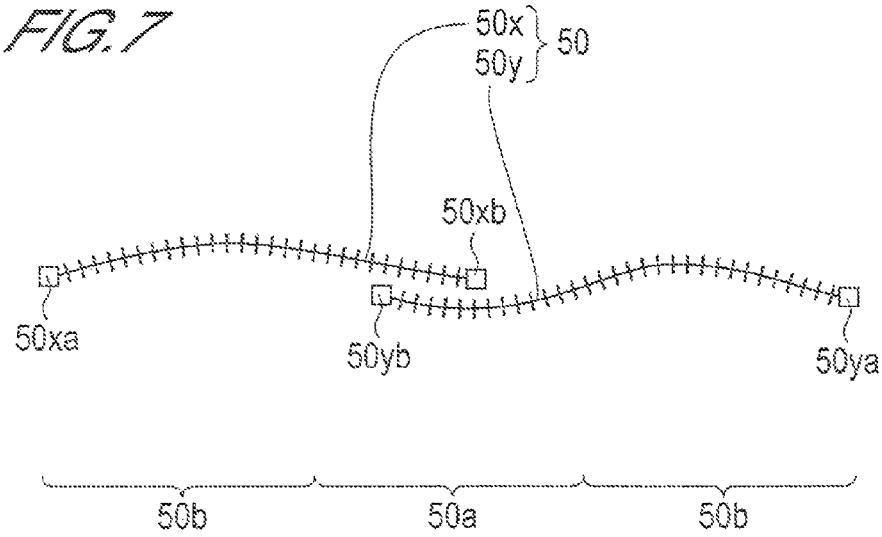
FIG. 7 is a schematic diagram showing an example in which the second zipper shown in FIG. 6 is configured as first and second sub-zippers separated on left and right hand side of a central section.

As shown in FIG. 7, it is preferred that the second zipper 50 be provided as first and second sub-zippers 50*x* and 50*y* that are separated on the left and right hand side of the central section 50*a*. In this case, according to the preferred example shown in FIG. 6, the first sub-zipper 50*x* extends from first upper end 50*xa* on a shoulder side, curves upward, falls downward at the central section, and then reaches a first lower end 50*xb* at a position past the center or an intermediate point of the second zipper 50.

On the other hand, the second sub-zipper 50*y* is substantially symmetric to the first sub-zipper 50*x*. In other words, the second sub-zipper 50*y* extends from a second upper end 50*ya* on a shoulder side, curves upward, falls downward at the central section, and then reaches a second lower end 50*yb* at a position past the center or an intermediate point of the second zipper 50. Therefore, in the central section 50*a*, the first lower end 50*xb* and the second lower end 50*yb* of the first sub-zipper 50*x* and the second sub-zipper 50*y* and the parts of the zippers extending from the first lower end 50*xb* and the second lower end 50*yb* toward the respective shoulder side sections 50*b* are separated in the height direction of the drysuit main body 20.

By dividing the second zipper into the first and second sub-zippers 50*x* and 50*y* on the right and left, the sub-zippers can be opened/closed individually using the right and left hands while visually checking the sub-zippers. As a result, the opening/closing operation of the second zipper 50 can be performed more easily and smoothly.

Although the operability is somewhat degraded compared to the configuration of the second zipper 50 of the preferred embodiment shown in FIG. 7, the first waterproof zipper 40 and the second zipper 50 may be placed so as to vertically overlap with each other over substantially the entire lengths thereof. Even with this configuration, the operability of opening/closing the zippers is dramatically better than those of the conventional drysuits.

Next, constitutional materials of the first and second zippers are simply described.

It is preferred that the first waterproof zipper 40 be formed from a soft and flexible material that is resistant to bending.

Thus, as the first tapes 48 of the first waterproof zipper 40, a conventional material such as the one obtained by coating a front or rear polyester surface with PVC (polyvinyl chloride), CR (chloroprene synthetic rubber), or PU (polyurethane) may be used. Alternatively, a material obtained by coating a polyester fabric with thermoplastic elastomer may be used.

In addition, the first elements 46 of the first waterproof zipper 40 may be formed from a conventionally known metallic material such as nickel silver (62% copper, 14% nickel, 24% zinc). Alternatively, a plastic material obtained by forming a nylon or polyester filament into a coil may be used.

The first slider 44 of the first waterproof zipper 40 may be formed from a conventionally known material such as an aluminum-bronze or stainless steel material.

In this preferred embodiment, "MasterSeal (brand name)" with closed ends, manufactured by TIZIP of Germany, was used as the first waterproof zipper 40. According to this waterproof zipper, the first tapes 48 each have a polyester base cloth coated with thermoplastic elastomer. Thus, when the rear fabric 60 of the drysuit main body 20 is made of PVC or polyurethane, the first tapes 48 can be welded easily to the rear fabric 60. When the rear fabric 60 is made of neoprene rubber, the first tapes 48 can be adhered easily to the rear fabric 60. Moreover, because the first elements 46 are plastic elements molded into coils as described above and therefore do not become rusted like metals, the first elements 46 can be used advantageously.

Because the first slider 44 is made of stainless steel as described above and therefore does not become rusted like metals, the first slider 44 can be used advantageously.

The waterproof zippers of "Master Series" are sufficiently soft, flexible, and resistant to bending, unlike metallic waterproof zippers, and therefore are particularly preferably used.

The second zipper 50, on the other hand, is made from a sufficiently soft and flexible material resistant to bending, as with the first waterproof zipper 40. However, it is preferred that the tapes of the second zipper 50 be formed from a material harder than that of the tapes of the first waterproof zipper 40. In this preferred embodiment, for example, a commercially available product, "#10C plastic zipper & slider," manufactured by YKK Group, is used as the second zipper 50, but the second zipper 50 is not limited thereto.

Next, an open angle suppressing part of a reinforcing material is described with reference to FIGS. 3, 4, 5 and 8.

FIGS. 5(A) to 5(F) and FIG. 8 are schematic diagrams for illustrating modifications of the open angle suppressing part.

FIGS. 3 and 4 show examples in which the open angle suppressing part is configured as the reinforcing material itself. This open angle suppressing part 80 is joined to the rear fabric 60, from the rear of the first waterproof zipper 40 along outer circumferences of the first tapes 48 of the first waterproof zipper (shown by a chain-line frame in FIG. 3, and also shown as a reinforcing material 80 in FIG. 4). The open angle suppressing part 80 can be joined to the rear fabric 60 by means of a sewing, adhesion or melting method. By joining the open angle suppressing part 80 to the rear fabric 60 of the drysuit, the rear fabric 60, the first tapes 48 of the first waterproof zipper 40, and the reinforcing material 80 are securely and firmly joined to one another. If need be, thus a waterproof or water guard treatment may be done to the obtained stitches.

When the wearer wears or takes off the drysuit main body 20 after opening the first tapes 48 by means of the first slider 44 of the first waterproof zipper 40, both of the first tapes 48 of the opened first waterproof zipper 40 are pulled forcibly to spread the open angle thereof more widely. In such a case, when the forcible pull force is added directly to the first elements 46 or the first slider 44 that is moved to the first lower end position, the first elements 46 and the first slider 44 might break, causing problems in the first waterproof zipper 40 and making the first waterproof zipper 40 unusable.

The open angle suppressing part 80 is provided in order to prevent damage to the first waterproof zipper 40 that is caused by the abovementioned strong pull force acting on the first waterproof zipper 40. When an external force such as a strong pull force acts on the first tapes 48 of the first waterproof zipper 40, the open angle suppressing part 80 serves to inhibit the pull force from being transmitted to the first tapes 48 on the first lower end 42*b* side, in order to prevent damage to the first waterproof zipper 40. In other words, the open angle suppressing part 80 acts as the reinforcing material for reinforcing the first tapes 48 on the first lower end 42*b* side. The open angle that can be suppressed by the open angle suppressing part 80 depends mainly on the position where the open angle suppressing part 80 is joined to the first tapes 48, and the difference in hardness of the materials used in the open angle suppressing part 80 and the first tapes 48. More specifically, when the open angle suppressing part 80 and the first tapes 48 are formed from materials of different hardness, an approximate open angle of the first tapes 48 is determined depending on the degree to which the first tapes 48 are allowed to open, in consideration of the difference in hardness of the materials. Therefore, the open angle may be defined previously when designing the tapes, and then the open angle suppressing part 80 may be joined to the tapes in accordance with an angle smaller the defined open angle.

It is preferred that the open angle suppressing part 80 be provided in an area in which the main opening 22*c* is opened to the maximum and which corresponds to the first lower end 42*b* and the first lower end position of the first waterproof zipper 40. From this area, the open angle suppressing part 80 bulges toward the chest area including this area, as shown in FIGS. 3 and 4.

In the preferred embodiment shown in FIGS. 5(A) to 5(F), the open angle suppressing part 80 has a base part 82*a* and a branching part 82*b* branching from the base part into two pieces. The base part 82*a* can be formed into a rectangle or any preferred shape. A concave part formed by the two pieces of the branching part 82*b* can be formed into a smoothly curved U-shape, a square U-shape, or a V-shape, but the shape of the concave part is not limited thereto. In the examples shown in FIGS. 5(A) to 5(C), the concave part is provided on a rectangular flat member. In the examples shown in FIGS. 5(D) to 5(F), the concave part is formed on a Y-shaped flat member. The reason that the open angle suppressing part 80 is divided into two pieces is to obtain an appropriate suppressing function of the open angle and to not narrow the main opening 22*c* as much as possible by means of the open angle suppressing part 80, in consideration of the fact that the first tapes 48 of the first waterproof zipper 40 are opened into two pieces from the first slider 44.

In the preferred examples shown in FIGS. 3 and 4, the open angle suppressing part 80 is formed as a flat bulging member that bulges into the main opening 22*c* from the first lower end position. This bulging member extends outward from a central area facing the first elements 46 of the first waterproof zipper and projects toward the chest part or the center of the first waterproof zipper 40 being closer than the first lower end position. Furthermore, an outer rim of the projecting part has a projecting outer rim 80*a* that is indented into a U-shape. FIG. 3 shows a state in which the U-shaped projecting outer rim 80*a* of the open angle suppressing part 80 serving as the reinforcing material is exposed toward the inside of the main opening 22*c* between the first elements 46. This projecting outer rim 80*a* is illustrated as a U-shaped, curved outer rim having a smooth indentation but may have a V-shaped indentation or be a flat straight outer rim, depending on the design.

According to the preferred embodiment of the open angle suppressing part 80—a reinforcing material—as described here, it is preferred that this open angle suppressing part 80 be constituted by a material harder than that of the first waterproof zipper 40, in particular, its first tape 48. In one preferred embodiment, it is preferred that the constitutional material or the material of the open angle suppressing part 80 be, for example, chloroprene synthetic rubber. As already known, this material has excellent waterproof property and is harder than the material of the first tapes 48 of the first waterproof zipper 40 and thus is hard to stretch. For this reason, even when the first tapes 48 are strongly pulled on the chest part side to open the open angle thereof, this pull force is suppressed by the open angle suppressing part 80 or the reinforcing material, whereby the pull force that is transmitted to the first tapes 48 on the first lower end 42*b* side is weakened. Therefore, even when a strong pull force is added to the first tapes 48, the occurrence of problems in the first elements 46 and the first slider 44 of the first waterproof zipper 40 can be prevented securely, and the safety of the drysuit main body 20 can be ensured.

Figure 8:
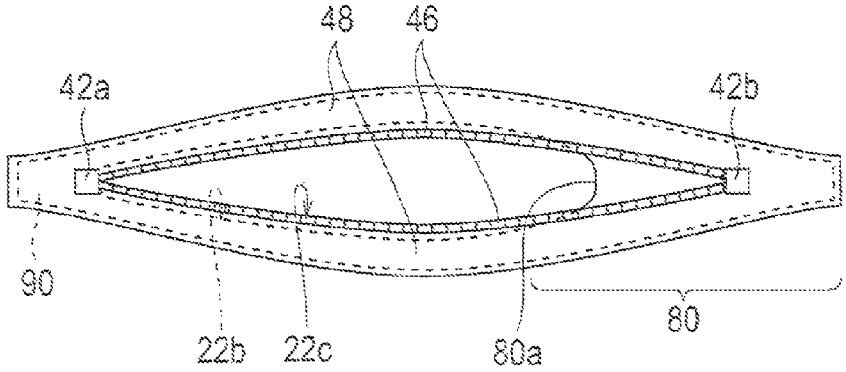
FIG. 8 is a schematic diagram for illustrating a modification of the open angle suppressing part shown in FIG. 4.

According to the configuration of the open angle suppressing part 80 or the reinforcing material of the preferred embodiment shown in FIG. 3, the open angle suppressing part 80 is provided on the first lower end side. However, the open angle suppressing part 80 may be provided along the entire length of the first tapes 48 of the first waterproof zipper 40, as shown in FIG. 8. How to provide the open angle suppressing part 80 is a matter of the design.

Note that FIG. 8 shows a configuration example in which the open angle suppressing part is provided in a part of a reinforcing material. In this case, a reinforcing material 90 has the open angle suppressing part 80, described using FIGS. 3 and 4, on the first lower end 42*a* side. FIG. 8 shows an example of a positional relationship of: the reinforcing material 90; the main opening 22*c*, the first elements 46, the first tapes 48, the first upper end 42*a* and the first lower end 42*b* of the first waterproof zipper; and the second sub-opening 22*b* and an inner rim section of the second sub-opening of the reinforcing material 90 that corresponds to the projecting outer rim 80*a* of the open angle suppressing part 80.

When the reinforcing material 90 is provided along the entire length of the first tapes 48, a flat material that can be joined to the whole of the entire first tapes 48 is prepared. Then, the second sub-opening 22*b* larger than the main opening is formed in an inner position on this material that corresponds to the main opening 22*c*. The shape of the inner rim of the opening on the first lower end side of the second sub-opening 22*b* may be similar to that of the projecting outer rim 80*a* described with reference to FIG. 3. The reinforcing material 90 made from the abovementioned flat material is joined to the first tapes 48 with the rear fabric 60 therebetween, along the entire circumference of the first tapes 48 of the first waterproof zipper 40, so that an inner circumferential rim of the second sub-opening 22*b* is positioned outside the main opening 22*c* along the inner circumferential rim thereof.

The present invention is not limited to the embodiments described above, and it is clear to those skilled in the art that the present invention can be modified or changed without departing from the spirit of the present invention.

EXPLANATION OF REFERENCE NUMERALS

10: Waterproof zipper
10*a*: Bulge
10*b*: Broken section
20: Drysuit main body
22: Opening part
22*a*: First sub-opening
22*b*: Second sub-opening
22*c*: Main opening
24: Air supply valve
26: Exhaust valve
30: Waterproof zipper device
40: First waterproof zipper
42*a*: First upper end
42*b*: First lower end 44: First slider
44*a*: First pulling cord
46: First elements
48: First tapes
50: Second zipper
50*a*: Central section
50*b*: Shoulder side section
50*x*: First sub-zipper
50*y*: Second sub-zipper
52*a*: Second upper end
52*b*: Second lower end
54: Second slider
54*a*: Second pulling cord
56: Second elements
58: Second tapes
60: Rear fabric
70: Front fabric
80: Open angle suppressing part (reinforcing material)
80*a*: Projecting outer rim
82*a*: Base part
82*b*: Branching part

The invention claimed is:

1. An underwater drysuit, comprising a body covering/uncovering opening part that is provided extending from one of shoulder parts to the other one of the shoulder parts on the top of arms across an area of a chest part of a drysuit main body in a chest width direction, said opening part being provided with a waterproof zipper device opening/closing defining said opening part, wherein said waterproof zipper device is configured in the shape of a horizontal line in said chest width direction to have a dual structure with a first waterproof zipper and a second zipper located above said first waterproof zipper in an inward/outward direction of said drysuit main body, wherein said first waterproof zipper has teeth and a slider, said teeth facing each other are provided along inner rims of two strips of elastic, waterproof tape, said slider adapted to bring into engagement said teeth with each other by the movement thereof;

said first waterproof zipper is joined to a rear fabric of said drysuit main body and defines a main opening of said opening part;

said second zipper is longer than said first waterproof zipper, is joined to a front fabric of said drysuit, defines a first sub-opening larger than said main opening above said main opening, and is provided in an arrangement relationship where said second zipper entirely or partially overlaps with said first waterproof zipper so as to press said first waterproof zipper from above combined with said front fabric of the drysuit, when a user wears said drysuit and closes said second zipper; and a reinforcing material that includes an open angle suppressing part, which is joined to said rear fabric along with both two strips of elastic, waterproof tape of said first waterproof zipper along outer circumferences of each said tape, from a rear side of said first waterproof zipper, and suppresses an open angle between said tapes to be opened by a slider of said first waterproof zipper, when said slider is moved to a position of a first lower end, which is a largest opening position of said first waterproof zipper, wherein this position is referred to as the first lower end position, and is then stopped at this lower end position.

2. The underwater drysuit according to claim 1, wherein said open angle suppressing part is formed from a flat member having a base part and a branching part branching from said base part into two pieces.

3. The underwater drysuit according to claim 2, wherein said flat member is a fabric.

4. The underwater drysuit according to claim 1, wherein said open angle suppressing part is provided in an area facing said first lower end and said slider stopped at said first lower end position.

5. The underwater drysuit according to claim 1, wherein said open angle suppressing part is formed from a material harder than that of said first waterproof zipper.

6. The underwater drysuit according to claim 1, wherein a central section of said second zipper that corresponds to a central area of said chest part is positioned downward in a height direction of said drysuit so as to be positioned lower than a shoulder side section corresponding to a shoulder side area.

7. The underwater drysuit according to claim 6, wherein said second zipper intersects with said first waterproof zipper between said shoulder side section and said central section in an area of said chest part.

8. The underwater drysuit according to claim 1, which is a diving drysuit.

9. The underwater drysuit according to claim 2, wherein said open angle suppressing part is provided in an area facing said first lower end and said slider stopped at said first lower end position.

10. The underwater drysuit according to claim 3, wherein said open angle suppressing part is provided in an area facing said first lower end and said slider stopped at said first lower end position.

11. The underwater drysuit according to claim 1, wherein a central section of said second zipper that corresponds to a central area of said chest part is positioned downward in a height direction of said drysuit so as to be positioned lower than a shoulder side section corresponding to a shoulder side area.

12. The underwater drysuit according to claim 11, wherein said second zipper intersects with said first waterproof zipper between said shoulder side section and said central section in an area of said chest part.

13. The underwater drysuit according to claim 4, wherein a central section of said second zipper that corresponds to a central area of said chest part is positioned downward in a height direction of said drysuit so as to be positioned lower than a shoulder side section corresponding to a shoulder side area.

14. The underwater drysuit according to claim 13, wherein said second zipper intersects with said first waterproof zipper between said shoulder side section and said central section in an area of said chest part.

15. The underwater drysuit according to claim 1, wherein said first waterproof zipper is adapted for opening/closing within a range wherein the wearer can visually check, and wherein the wearer's hands may reach said opening/closing range of said first waterproof zipper on the chest part side.

16. The underwater drysuit according to claim 1, wherein said second zipper is provided with tapes formed from a material harder than that of the tapes of the first waterproof zipper.

* * * * *